US006986817B2

(12) United States Patent
Riefenstein et al.

(10) Patent No.: US 6,986,817 B2
(45) Date of Patent: Jan. 17, 2006

(54) METHOD OF AUTOMATIC CLEANING OF COOKING CAVITIES

(75) Inventors: Lutz Riefenstein, Weihelm (DE); Dario Manicardi, Carpi (IT)

(73) Assignee: Convotherm Elektogerate GmbH, Eglfing (DE)

( * ) Notice: Subject to any disclaimer, the term of this patent is extended or adjusted under 35 U.S.C. 154(b) by 329 days.

(21) Appl. No.: 10/369,930

(22) Filed: Feb. 19, 2003

(65) Prior Publication Data

US 2003/0172962 A1 Sep. 18, 2003

(30) Foreign Application Priority Data

Feb. 21, 2002 (DE) ..... 102 07 306

(51) Int. Cl.

| | |
|---|---|
| ***B08B 3/04*** | (2006.01) |
| ***B08B 9/027*** | (2006.01) |
| ***C23F 11/02*** | (2006.01) |
| ***A61L 2/07*** | (2006.01) |

(52) U.S. Cl. ..... 134/20; 134/22.12; 134/22.14; 134/22.15; 134/22.19; 134/24; 134/25.3; 134/30; 134/35; 134/37; 134/39; 510/197; 422/11; 422/14; 422/26

(58) Field of Classification Search ..... 134/20, 134/22.12, 22.14, 22.15, 22.19, 24, 25.3, 134/30, 35, 37, 39; 510/197; 422/11, 14, 422/26

See application file for complete search history.

(56) References Cited

U.S. PATENT DOCUMENTS

| | | | | |
|---|---|---|---|---|
| 3,419,428 | A * | 12/1968 | Welch | 134/22.17 |
| 6,909,071 | B2 * | 6/2005 | Shozo | 219/401 |
| 2003/0172962 | A1 * | 9/2003 | Riefenstein et al. | 134/42 |

FOREIGN PATENT DOCUMENTS

| | | |
|---|---|---|
| DE | 28 42 771 A1 | 4/1980 |
| EP | 0 892 220 A1 | 1/1999 |

* cited by examiner

*Primary Examiner*—Brian P. Mruk
(74) *Attorney, Agent, or Firm*—Ohlandt, Greeley, Ruggiero & Perle, L.L.P.

(57) ABSTRACT

A method of automatic cleaning of cooking cavities of cooking equipment for food processing includes the introduction of steam at a temperature of at least 100.deg. C. from a supply line and nozzle into a cooking cavity for a time period depending on the degree of disinfection desired. The cooking cavity is rinsed with the steam condensate; and the supply line and nozzle are flushed with demineralized water.

4 Claims, No Drawings

METHOD OF AUTOMATIC CLEANING OF COOKING CAVITIES

PRIORITY CLAIM

This application claims priority to application DE 102 07 306.6 filed Feb. 21, 2002 in Germany.

FIELD OF THE INVENTION

The invention relates to a method of automatic cleaning of cooking cavities of cooking equipment for food processing. More specifically, all surfaces and parts of the cooking areas are sprayed with a cleaning solution, the cleaning solution is allowed to act for a predetermined period of time, the cooking cavity is rinsed and the supply line and nozzle carrying the cleaning solution are flushed.

BACKGROUND OF THE INVENTION

When the cooking cavities of hot-air steam ovens are cleaned, the cleaning solution used is sprayed into the dried or moistened cooking cavity. After letting the cleaning solution act for a predetermined period of time, the cooking cavity is rinsed out with water. The lines and nozzles which distribute the cleaning solution are also cleaned.

However, depending on the degree of fouling, these steps are sometimes repeated several times. To prevent leaving scale deposition in the cooking cavity by the rinse water while it is drying off, a dishwashing liquid is introduced into the cooking cavity via the nozzles from which the cleaning solution is sprayed. This results not only in the cleaning of the lines and nozzles, but also, in a decrease of the surface tension of the water, which in turn prevents rapid flowing off of the water and causes the formation of scale residues.

This type of automatic cleaning of the cooking cavity is not only expensive since it must use dishwashing liquid, but is also unsatisfactory with respect to microorganism destruction.

SUMMARY OF THE INVENTION

It is an object of the present invention to develop a method such that scale deposits can be prevented more cheaply and higher levels of hygiene are achieved.

This and other objects and features of the present invention will become apparent from the following detailed description.

DETAILED DESCRIPTION OF THE PRESENTLY PREFERRED EMBODIMENTS

The present invention is directed to a complete cleaning operation by introducing steam into the cooking cavity at a temperature of at least 100.deg. C. for a time period depending on the degree of disinfection sought. Further, demineralized water is used for cleaning the lines and nozzles bearing the cleaning solution.

By introducing essentially saturated steam into the cooking cavity, primarily steam disinfection is carried out, so that for the usual situation the equipment may be considered sufficiently hygienically clean after this disinfection. A further important advantage of using a supply of steam is that very heavy condensation occurs on the walls which were previously cooled by rinsing off with cold water, so that the walls and all parts of the cooking cavity are now rinsed off with condensate water. Since condensate water does not contain lime, no lime spots can form in the cooking cavity. Since in the present inventive method, the dishwashing liquid, which is usually used for cleaning the nozzles and for rinsing the walls of the cooking cavity, is no longer employed, the cost of cleaning is considerably decreased. The use of demineralized water for cleaning the nozzles represents only a small part of the previous costs, since this water is only used for nozzle cleaning and not for rinsing the walls, which are kept scale free by the condensate water.

To achieve adequate steam disinfection, in an embodiment of the present invention it is sufficient to introduce steam into the cooking cavity for a time period of 5–10 minutes. In this time period, sufficient condensate water has also formed that the walls can be sufficiently flushed.

If it should prove that rinsing the lines and nozzles with demineralized water is not sufficient to neutralize even the final residues of the cleaning solution, in a further embodiment of the invention it is advantageous if a food acid is added to the demineralized water. The food acid used is preferably citric a acid.

Depending on the requirement of the hygienic conditions, it can be advantageous if a hot-air sterilization is carried out after the steam disinfection. By this means it is possible to achieve hygienic conditions as are achieved in the clinical sector.

Preferably, hot-air sterilization is performed at a temperature of at least 160.deg. C. for a time period depending on the degree of sterilization sought.

Depending on the intended degree of sterilization, the hot-air sterilization can be carried out at a temperature of 160.deg. C. for 200 minutes, at a temperature of 180.deg. C. for 30 minutes, and at a temperature of 200.deg. C. for 10 minutes.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. A process for the automatic cooking chamber cleaning of cooking equipment for processing foodstuffs, comprising:

spraying of all surfaces and parts of the cooking chamber with a cleaning solution and the action of the cleaning solution over a preselected period of time;

rinsing out of the cooking chamber and the subsequent rinsing of the lines and nozzles conveying the cleaning solution;

then introducing steam at a temperature of at least 100° C. into the cooking chamber over a period of time that depends on the degree of disinfection that is sought; and subsequently rinsing the lines and nozzles conveying the cleaning solution with demineralized water.

2. The process according to claim 1, wherein the introduction of steam into the cooking chamber takes place over a time period of 5–10 minutes.

3. The process according to claim 1, wherein a food acid is added to the demineralized water.

4. The process according to claim 3, wherein citric acid is used as the food acid.

* * * * *